US005179918A

United States Patent [19]

Gyurovits

[11] Patent Number: 5,179,918

[45] Date of Patent: Jan. 19, 1993

[54] TIMING-RANGE GEAR

[76] Inventor: John S. Gyurovits, 2256 Brookside Dr., Martinsville, N.J. 08836-9659

[21] Appl. No.: 721,400

[22] Filed: Jun. 26, 1991

[51] Int. Cl.[5] ..... F01L 1/34

[52] U.S. Cl. ..... 123/90.17; 123/90.31; 464/1; 464/2

[58] Field of Search ..... 123/90.12, 90.13, 90.15, 123/90.17, 90.31; 464/1, 2, 160

[56] References Cited

U.S. PATENT DOCUMENTS

| | | | |
|---|---|---|---|
| 3,262,435 | 7/1966 | Cribbs | 123/90.15 |
| 3,978,829 | 9/1976 | Takahashi et al. | 123/90.15 |
| 4,231,330 | 11/1980 | Garcea | 464/2 |
| 4,250,859 | 2/1981 | Scheying | 464/1 |
| 4,421,074 | 12/1983 | Garcea et al. | 123/90.15 |
| 4,494,495 | 1/1985 | Nakamura et al. | 123/90.15 |
| 4,494,496 | 1/1985 | Nakamura et al. | 123/90.15 |
| 4,513,724 | 4/1985 | Kamleitner | 464/1 |
| 4,535,731 | 8/1985 | Banfi | 123/90.15 |
| 4,545,338 | 10/1985 | Allred, III | 123/90.15 |
| 4,561,390 | 12/1985 | Nakamura et al. | 123/90.15 |
| 4,577,592 | 3/1986 | Bosch et al. | 123/90.15 |
| 4,627,825 | 12/1986 | Bruss et al. | 464/2 |
| 4,754,727 | 7/1988 | Hampton | 123/90.15 |
| 4,762,097 | 8/1988 | Baker | 123/90.17 |
| 4,787,345 | 11/1988 | Thoma | 123/90.17 |
| 4,858,572 | 8/1989 | Shirai et al. | 123/90.12 |
| 4,955,330 | 9/1990 | Fabi et al. | 123/90.17 |
| 4,960,084 | 10/1990 | Akasaka et al. | 123/90.17 |
| 4,961,406 | 10/1990 | Burandt | 123/90.15 |
| 5,090,365 | 2/1992 | Hotta et al. | 123/90.17 |

FOREIGN PATENT DOCUMENTS

| | | | |
|---|---|---|---|
| 322121 | 6/1920 | Fed. Rep. of Germany | 464/1 |
| 450132 | 3/1913 | France | 464/1 |
| 309704 | 12/1988 | Japan | 123/90.17 |

*Primary Examiner*—E. Rollins Cross
*Assistant Examiner*—Weilun Lo

[57] ABSTRACT

This invention, relates to direct acting valve timing-varying gear devices, which is used to change the opening and closing times of valves of an internal combustion engine. The preferred embodiment is comprised of an outer gear means in which there is a hub means having a circular periphery in rotatable sliding contact therewith and there is a plurality of phasing weights slidably disposed therein. Each of said weights having a phasing profile thereon which slideably interacts with the trailing edge of a cavity within said gear means and against the reactive side of a corresponding cavity within said hub means. Said weights respond to centrifugal force exerted thereon and by collective cooperation with said gear and hub means, said force overcomes the natural resistive torque of the camshaft thereby causing said hub to advance relative to said outer gear means. A hydraulically actuated embodiment is comprised of an outer toothed pulley means, an inner hub means and an annular piston means being seal-ably interfaced thereinbetween. Said pulley and hub, having suitable means at the forward part thereof which convolutionally enmesh with the helicoidal splines of said piston means and cooperatively transform the rotating axial movement thereof into an angular dispalcement of said hub relative to said pulley means.

25 Claims, 4 Drawing Sheets

29
30
13
31
9
23
24
25
18
28
26
27
4
15
21
22

16
15
1
8

3
4
17
15
16
19
20
21
12
8
14
3

2
1
3
2
7
6
5
4

TIMING-RANGE GEAR

SUMMARY OF THE INVENTION

The present invention relates generally to timing gear means used in internal combustion engines, and specifically for varying the angular phase between the camshaft and crankshaft thereof. The valve Timing-Range Gear disclosed herein represents the state of the art in engineering science, related economic factors and environmental considerations. It provides a simple low-cost but highly reliable and technically sound gear means for converting the fixed-point camshaft to crankshaft phase into an active angular range between two predetermined limits. The preferred embodiment comprises phasing weights, which are slidably disposed within a hub and gear means and with increasing engine RPM as centrifugal force is acting thereon, then said weights correspondingly advance the hub with respect to said gear means, thus affecting the original phasing between camshaft and crankshaft. With lowering of engine RPM, the inherent camshaft torque forces said phasing weights back into the hub means until at end-point the original phase is re-established.

For an alternate embodiment the phasing weights are variably assisted by the hydraulic system pressure that is supplied by the oil pump of the engine's own lubricating system.

And in yet another embodiment in which only three major components are used, phasing is actuated solely by hydraulic means. The hub and pulley are correspondingly configured to provide a cylinder cavity, and both are sealably coacting with an annular piston means therein; Said piston having a plurality of helicoidal splines on the foreward portion thereof which slideably enmesh with the corresponding grooves of said hub and pulley means. When hydraulic pressure is applied to the cylinder cavity then said piston is forced helically outward and by overcoming the natural resisting torque of the camshaft causes a change of angular position between said hub and pulley. Diminished hydraulic pressure therein returns said piston to the stop and the original camshaft to crankshaft phase is re-established.

BACKGROUND OF THE INVENTION

1. Field of the Invention

The present invention relates generally to internal combustion engines, having intake and exhaust valves that are linearly actuated by camshaft means, and with said camshaft means having a timing gear or timing sprocket means removably attached thereto. Said engine also having linearly reciprocating piston means, and connected to a crankshaft, which has a suitable driving gear means thereon in a predetermined fixed phase to said timing gear means. More specifically, this invention pertains to methods and mechanisms which are used for automatically varying and/or governing the phased timing of opening and closing of the intake and exhaust valves of said engine.

2. Description of the Prior Art

State of the art valve timing-varying means which are provided for liquid and/or gas fuel burning internal combustion engines especially those which are utilized for but not limited to those providing vehicular locomotion, are the performance compromised product of engine technologies, prevailing economic factors and environmental constraints. These engines depend on high component-density electronic subsystems for their overall performance and for controlling the function of complex electromechanical, or hydro-mechanical subsystems or selected combinations thereof, to vary the opening and closing times of valves relative to the angular position of the crankshaft. While these systems improve fuel efficiency and engine performance, they are beset with problems which are characteristically inherent in complex high component-density system designs. The advantages gained are frequently offset by system failure, due to the high rate of subsystem component malfunctions. In prior arts U.S. Pat. No. 3,978,829 Takahashi, and U.S. Pat. Nos. 4,494,495, 496, and 4,561,390 Nakamura et al. are noted complex, subsystem-interdependent and highly component-dense systems, that are costly to manufacture and maintain. Along with added electronic controls, they are also excessively bulky and further with their substantial overhanging rotating weight, they expand the engine size and weight envelope to accommodate the additional loads. Heavy dependence on automotive electronics for control functions is also evident in the art of U.S. Pat. No. 4,754,727 Hampton. This system further expands the long list of engine performance related electronic controls and adds to the cost of manufacture and general maintenance. In hydro-mechanical art disclosed in U.S. Pat. No. 4,627,825 Bruss et al., overall functional reliability is greatly reduced by the added number of electronic components required to control and monitor the operation of the device. Also, the costs of manufacture and general maintenance is escalated. Similarly, U.S. Pat. No. 4,535,731 Banfi, and U.S. Pat. No. 4,787,345 Thoma, disclose enmeshed straight and helical splines in various combinations for transferring axial action into angular displacement. However, they too are among the high component-density systems, and as such are plagued by the same high-cost to benefit ratio problem as the above referred art of Takahashi and Nakamura. For an all hydraulically operated device, as disclosed in U.S. Pat. No. 4,858,572 Shirai et al. the plurality of vanes lack the positive seals needed to maintain precise angular position under any operating condition.

OBJECTS OF THE INVENTION

The primary object of the invention is to provide a totally self-contained valve Timing-Range Gear means, which will automatically vary the valve timing phase of internal combustion engines with a high degree of reliability, to best suit load requirements within its predetermined limits.

It is also the object of this invention that said gear means be comprised of minimum number of mechanical components and be interconnected to cooperatively respond to changes in engine speeds and correspondingly alter the engine's camshaft to crankshaft phase, without depending on externally processed signals transmitted by any other subsystems.

Another object is to provide an all-mechanical valve Timing-Range Gear means of minimum size and rotating weight, which will readily interface with current as well as earlier manufactured engine components.

And yet another object is that said gear means in at least one of the several preferred embodiments, respond to centrifugal force acting thereon; and in another is to respond to the combined actions of centrifugal force and hydraulic pressure therein; and yet another, to respond to hydraulic pressure only, with predictable results.

It is also an object that each type of said gear means can be produced and assembled economically by state of the art methods, and that in its intended operation it does not require any dedicated maintenance.

Other objects and advantages which are peculiar to the features of the Timing-Range Gear means of this invention will become readily apparent, and can best be understood by examining the following descriptions when taken in conjunction with the accompanying reference drawings, illustrating the several embodiments which are being disclosed herein.

DETAILED DESCRIPTION OF THE SEVERAL EMBODIMENTS

The Timing-Range Gear means of this invention which is being disclosed herein contains specifications and drawings which illustrate the several embodiments whose components are identified by numerals and whose features will be more fully understood when read in conjunction with the accompanying drawings.

Figure 3:
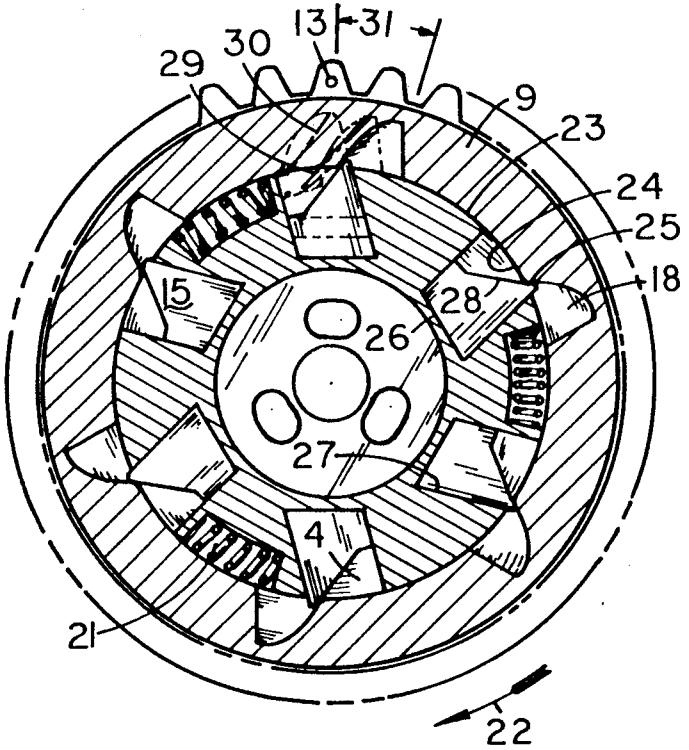
FIG. 3 of sheet 1, is a cross sectional view taken along the line 3—3 of FIG. 2.
Figure 4:
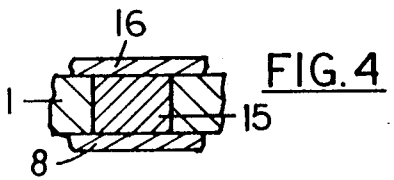
FIG. 4 of sheet 1, is a partial cross sectional view taken along the line 4—4 of FIG. 2 of this embodiment of the invention.
Figure 2:
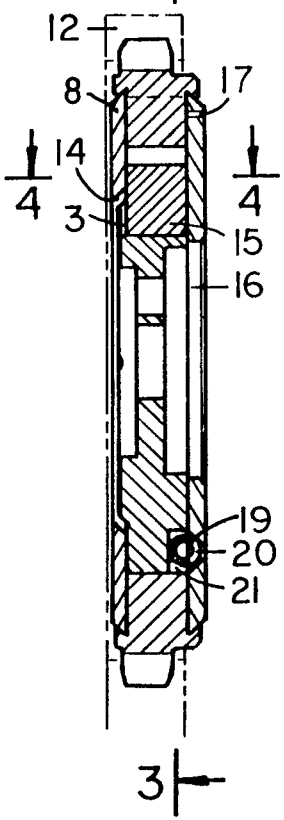
Figure 1:
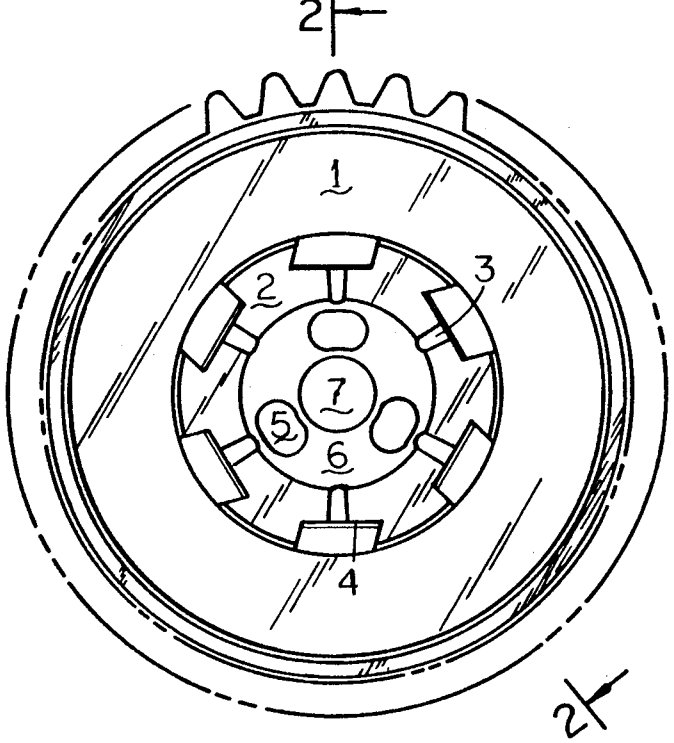
FIG. 1 of sheet 1, is a full plan view illustrating the camshaft interfacing side of one of the several embodiments of this invention, FIG. 2 of sheet 1, is a cross sectional view taken along the lines 2—2 of FIG. 1.

In FIG. 1 sheet 1 of 4 the preferred embodiment hub member 1, has a thrust bearing 2 which has a plurality of radial grooves 3, each of which is in communication with the corresponding cavity 4. A plurality of elongated mounting holes 5 through flat-bottom 6 and center hole 7 are to be used for alternate mounting or centrally locating said gear means to camshaft. First side cover 8 is being fixedly interfaced with ring gear means 9. Through the toothed periphery 11 said gear means is being driven by timing chain 12, FIG. 2 and phased to the driving gear means of the crankshaft (not shown) by timing mark 13 of FIG. 3. The inwardly leading edge 14 of first side cover 8 channels lubricating oil into each of cavities 4 for lubricating weights 15 therein, FIGS. 2 & 3. The second side cover 16 also is being fixedly interfaced with said gear member 9 thus together with first side cover 8 slideably keeps each of said weights 15 in cavities 4. A plurality of bleed-off holes 17 are equally spaced on a circular center line in close proximity to the apex of each cavity 18 FIG. 3 and each provides a means for excess oil to be expelled therefrom. A plurality of slots 19 angularly expanding inward through the second side cover 16, keep springs 20 workably in slot 21 of hub member 1, FIGS. 2 & 3. The load bearing periphery 23 of hub 1 being in rotatably slideable contact with bore 24 of gear member 9, and spring 20 being in longitudinal tension in slot 21 of hub 1 by one end of slot 21 and the opposite end of slot 19 of side cover 16 thereby maintaining closed position of the timing-range gear before installation and during initial set-up. Rotation is indicated by arrow 22 of FIG. 3. When gear 9 is driven in the direction of arrow 22 the operating torque of the camshaft acting on hub 1 forces the plurality of weights 15 into compression between the trailing edge 25 of cavity 18 in gear 9 and bottom 26 of cavity 4 of hub 1, thus each weight 15 provides a rotational interlock thereinbetween. When centrifugal force is acting on the plurality of weights 15 then each is sliding outward against the side 27 of cavity 4, and the phasing profile 28 of each weight 15 slidingly interacts with the trailing edge 25 of cavity 18 causing angular change between hub 1 and gear 9. The phantom outline of weight 15 is indicated by numerals 29 and 30 showing the progressive action of the weights 15 as being driven by the centrifugal force into cavity 18, and numeral 31 indicates the resultant angular change thereof.

Figure 6:
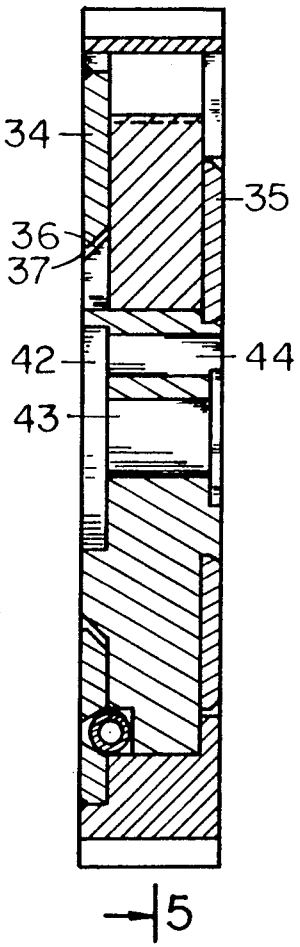
FIG. 6 of sheet 2, is a longitudinal cross sectional view taken along the line 6—6 of FIG. 5.
Figure 5:
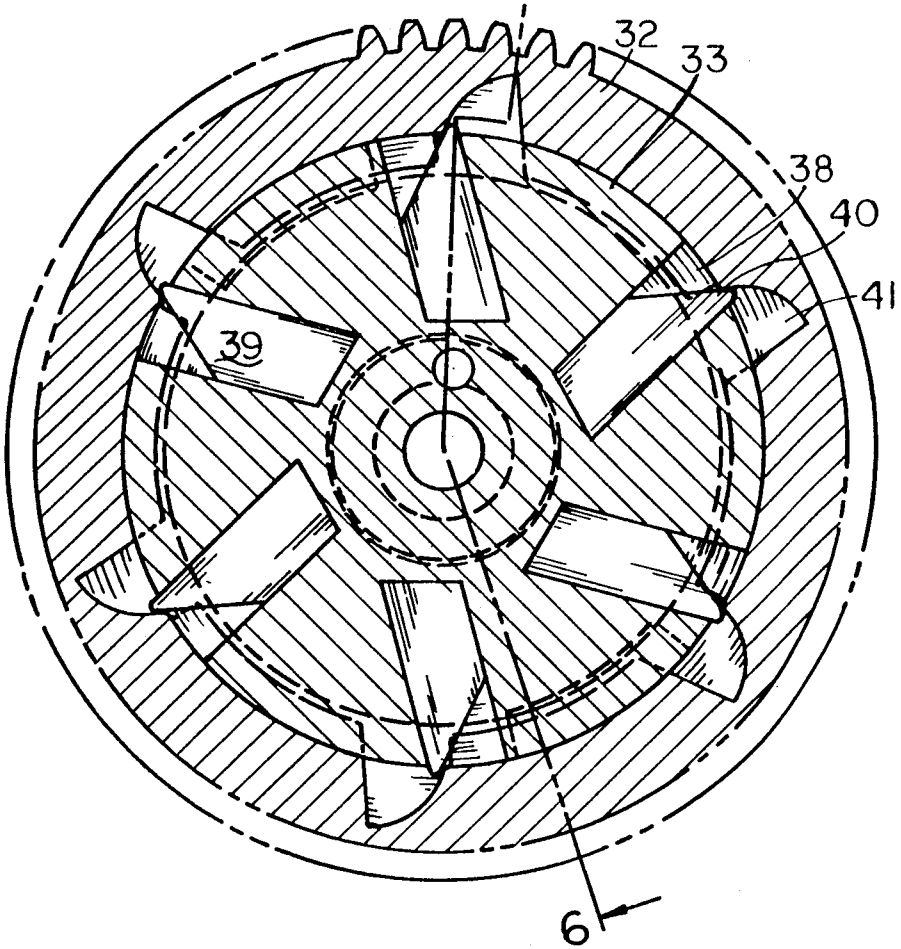
FIG. 5 of sheet 2, is a crossectional view of another embodiment of this invention, taken along line 5—5 of FIG. 6.

In the alternate embodiment of this invention as shown in FIGS. 5 and 6 of sheet 2 of 4, the gear member 32 being driven directly by the crankshaft gear (not shown) and hub 33 being secured in rotatably slideable contact therewith between first side cover 34 and second side cover 35. The periphery of first side cover 34 being fixedly made a part of gear member 32 adds physical strength to the gear, and the inwardly leading angular edge 36 provides means for lubricating oil to enter cavity 38 to assure unhindered sliding action for the plurality of centrifugal weights 39 therein. The second side cover 35 being fixedly made a part of hub 33 and in slidable contact with each weight 39, and together with first side cover 34 keeps each weight 39 in slidingly working position within cavity 38 of hub 33 and trailing edge 40 of cavity 41 in gear 32. The flat-bottom bore 42 receives the camshaft (not shown) and the timing-range gear means being removably interfaced thereto by threaded fastener means (not shown) through center bore 43. Bore 44 interlocks with locating pin within the end of the camshaft. (not shown) All other aspects of this embodiment are compatible with the preferred embodiment of the timing-range gear means shown by FIG. 1.

Figure 8:
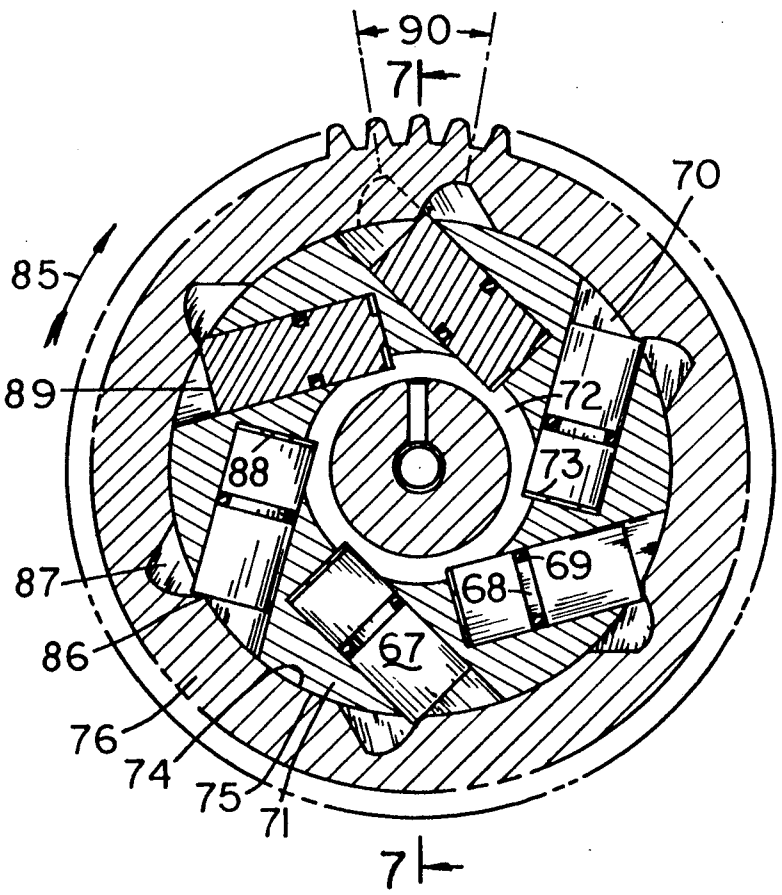
FIG. 8 of sheet 3, is a cross sectional plan view taken along the line 8—8 of FIG. 7.
Figure 7:
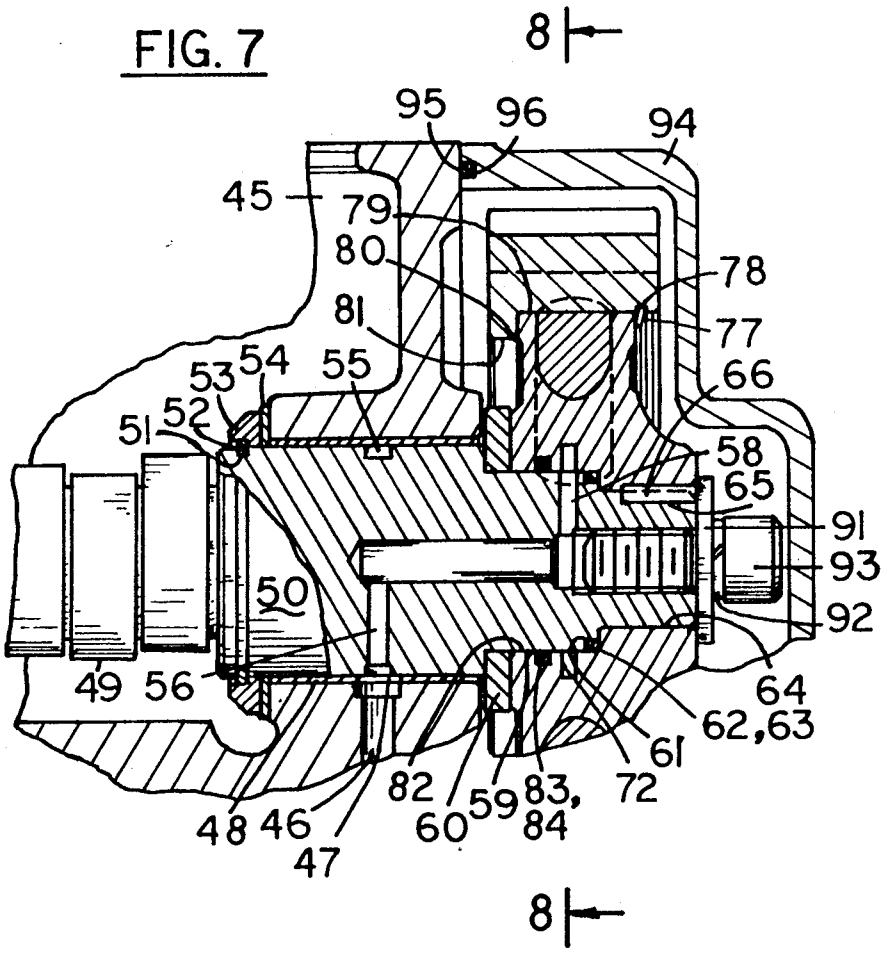
FIG. 7 of sheet 3, is a partially exploded longitudinal cross sectional view of another embodiment of this invention taken along the line 7—7 of FIG. 8.

Another embodiment of the timing-range gear means of this invention is being shown in FIGS. 7 and 8 of sheet 3 of 4, wherein the numeral 45 denotes the engine block with an oil passage 46 in it which provides the means for an oil pressure supply through a hole 47 in bearing 48. Camshaft 49 being journally supported within bearing 48. In close proximity to the inner end of journal 50 is an outside circumferential groove 51 in which a resilient locking-ring means 52 being radially secured by the overextending end of the axial-locking thrust plate means 53 and cooperatively they provide a means for securing the camshaft 49 within the engine block 45 in one axial direction. Inside thrust bearing 54 provides added sliding surface between the block 45 and thrust plate 53. Circumferential groove 55 communicates with oil pressure supply passage 46, through passage 56 and axial passage 57 and also with passage 58 within journal 50 of camshaft 49. The first reduced diameter 59 rotatably interfaces with outer thrust bearing 60, and the second reduced diameter 61 forms the two conjuncting sides of groove 62 for resilient "O" ring seal means 63. The third reduced diameter 64 has the longitudinal keyway 65 for key 66. The plurality of centrifugal weights 67 each of which has a circumferential groove 68 cut within the circular periphery thereof for "O" ring seal means 69. One of each weights 67 being slideably disposed in each of a plurality of circular bores 70 in the hub member 71 and directly communicating with oil pressure groove 72 at the bottom 73 of each bore 70. The load bearing periphery 75 of hub 71 being in slideably rotatable contact with bore 74 of gear 76, and hub 71 being axially secured therein by a resilient dished type locking ring means 77 in the inside circumferential groove 78 within bore 74. Lubricating oil is delivered to the inner sliding surface 79 by the inwardly leading surface 80 of bore 81. The first bore 82 of hub 71 has a circumferential flat bottom groove 83 in which a resilient "O" ring seal means 84 sealably interfacing the first reduced diameter 59 and together with "O" ring seal 63 provides a pressure tight chamber within groove 72 and the interconnecting passage ways for the hydraulic actuation of each of the plurality of weights 67 within each of bores 70. Arrow 85 indicates direction of operating rotation. In the neutral mode of the timing-range gear means of this embodiment the driving force of gear member 76 through the trailing edge 86 of cavity 87 forces each weight 67 into the bottom of bore 70 where the bottom 88 of each weight 67 interlocks the hub 71 and gear 76. When the plurality of weights 67 are forced outward the phasing profile 89 of each weight 67 cooperates with the trailing edge 86 of each cavity 87 and coactingly causes an angular change of position between hub 71 and gear 76. The limits of angular change are indicated by numeral 90. This embodiment is mounted onto the camshaft in an angularly fixed position by key 66 which radially interlocks with flat washer 91 that is secured in place by lock washer 92 and cap screw 93. The cover 94 has a resilient seal means 95 in a flat bottom groove 96 providing a leak-proof closure therefor.

Figure 10:
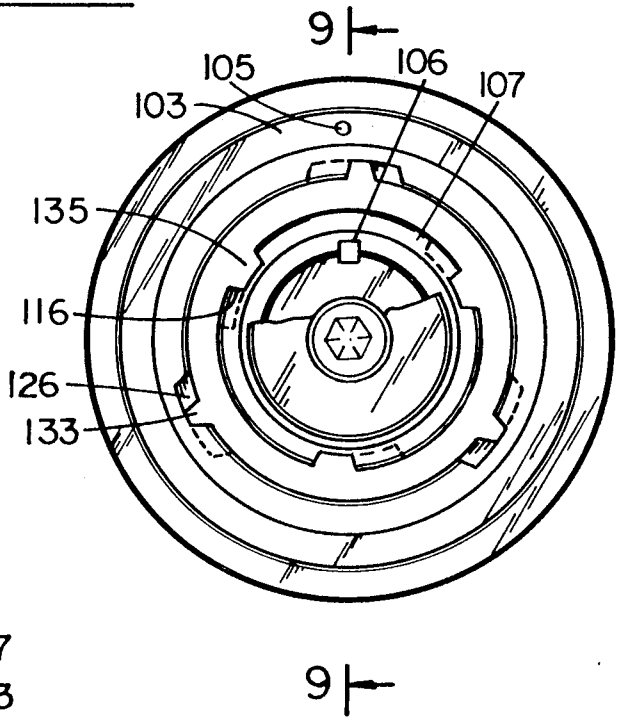
FIG. 10 of sheet 4, is a partially exploded plan view of FIG. 9.
Figure 11:
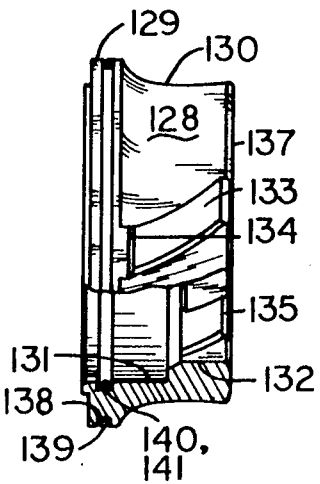
FIG. 11 of sheet 4, is a partially exploded side elevational view of the annular piston, shown in FIG. 9 of this embodiment of this invention.
Figure 9:
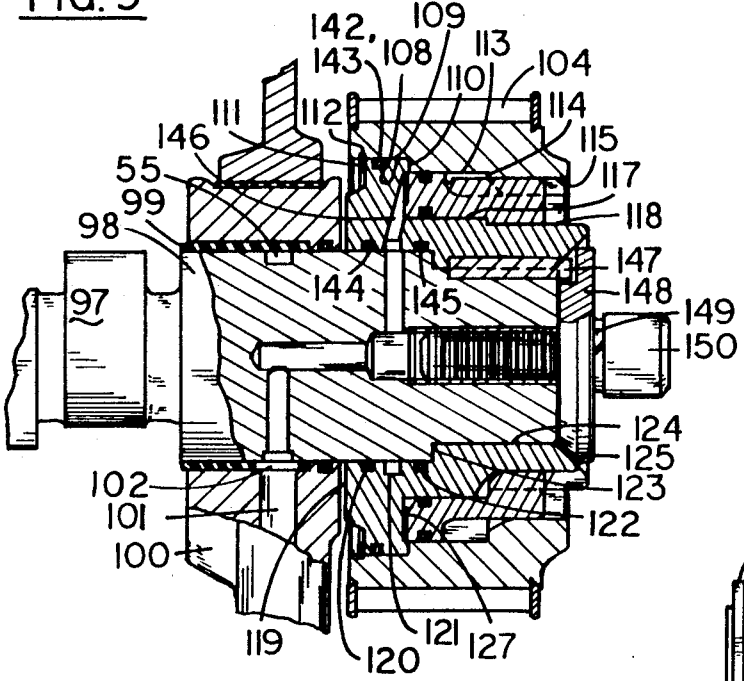
FIG. 9 of sheet 4, is a partially exploded longitudinal cross sectional view of yet another embodiment of the invention, taken along the line 9—9 of FIG. 10.

The present invention as illustrated in FIGS. 9, 10 and 11 of sheet 4 of 4 is a timing-range pulley embodiment in which the camshaft 97 has the end journal 98 rotatably secured in bearing 99 within bearing boss 100, that is an integral part of the engine's cylinder head or can be part of the cylinder block (not shown). The camshaft end journal 98, similarly to that of camshaft 49 which has been described in the foregoing embodiment, has a circumferential groove 55 on the periphery in communication with oil pressure supply passage way 101 through hole 102 of bearing 99. The pulley member 103 having toothed periphery 104 to engage the driving pulley of the crankshaft (not shown). Timing mark 105 is in phased relative position to keyway 106 in hub member 107. The load bearing surface of first bore 108 is in slideably rotating contact with outer periphery 109 of hub 107 and axially secured therein by first inner planar surface 110 and retainer ring 111 in a circumferential inside groove 112 of bore 108. Pulley member 103 has second bore 113 ending at the second inside planar surface 114, and third bore 115 extends therethrough in which a plurality of helicoidal inside grooves 116 extend from planar surface 114 to the end of pulley 103. Hub member 107 has a second load bearing periphery 117 and a third 118 at the outer end thereof. Also it has a first inside bore 119 in which a circumferential flat bottom groove 120 is in close proximity to its end, there is a second groove 121 being larger than groove 120, and a third groove 122 being identical to groove 120 and in close proximity to inside planar surface 123 from which a second bore 124 ends at counter sink 125. On the load bearing surface 118 there is a plurality of helicoidal outside grooves 126 extending to end of hub 107. The second bore 113 of pulley 103 and second load bearing periphery 117 of hub 107 together coactively form an angularly active annular cylinder between the second inside planar surface 114 of pulley 103 and flat bottom surface 127 of hub 107, for annular piston 128. The outside load bearing periphery 129 and 130 of piston 128 is interfacing in slideably rotating contact with the second bore 113 and third bore 115 of pulley 103, and first bore 131 and second bore 132 of piston 128 likewise also interfacing the second load bearing surface 117 and third load bearing surface 118 of hub member 107. There is a plurality of outside helicoidal splines 133 extending forward from outside stop surface 134 to the end, and a plurality of inside helicoidal splines 135 extending outward from the inside stop surface 136 to end 137 of piston 128. There is an outside circumferential groove 138 for resilient "O" ring seal 139 in load bearing periphery 129 and an inside circumferential groove 140 for resilient "O" ring seal 141 in first bore 131 to sealably interface bore 113 of pulley 103 and periphery 117 of hub 107. A resilient outside "O" ring seal 142 in groove 143 of hub 107 and resilient inside "O" ring seal 144 and 145 in first inside bore 119 provide pressure tight sealing action therein. Passage way 146 interconnects the second inside groove 121 and flat bottom 127 and provides a means for oil pressure to activate the annular piston 128 in an outward direction. As the helicoidal splines 133 and 135 slideably enmesh each corresponding helicoidal groove 116 and 126 they provide a rotational sliding interlock which when piston 128 extends outward then hub 107 as well as pulley 103 are being angularly displaced with respect to piston 128. When hydraulic pressure is greater then the camshaft torque resistance that is acting on the hub 107 piston 128 is extended outward causing an angular shift in one direction, and as oil pressure drops then it is being forced inward, with previous angular shift then being diminished proportional to the oil pressure present within the pressure chamber. Key 147 by extending into end cap 148 provides a rotational interlock therefor and between camshaft journal 98 and hub 107. End cap 148 being secured in place by lock washer 149 and cap screw 150.

From the foregoing detailed description and accompanying drawings, it is evident that this invention is well adapted to attain all the ends and objects hereinabove set forth together with other advantages which are directly attributed to the valve Timing-Range Gear and to those which are the derived extensions thereof.

It is therefore to be understood that certain features and combinations of selected features and/or various sub-combinations derived therefrom may be employed by those skilled in the art to produce yet another new feature or group of new features, without reference thereto and this is contemplated by and is within the scope and spirit of the invention and claims.

Since it is possible to produce derivative embodiments in various combinations from extensions of features without deviating from the scope and spirit of the invention therefore, it is to be understood that all matters described and made reference thereto in the foregoing description and specification are part of the legal equivalent of the following claims and not to be construed as limitations of the scope and spirit of the invention.

The disclosed embodiments, the scope and spirit of the invention for which an exclusive property or privilege is claimed are defined as follows:

1. A variable valve timing device used as a compact integral part of an internal combustion engine for adjusting a relative angular position of a driven camshaft having a central longitudinal axis with respect to an angular position of a driving crankshaft, said device includes a camshaft gear means comprising:

a hub member, having an axial bore for removably interfacing the camshaft, and having a circular load-bearing periphery and a first cavity means for receiving and comparatively interacting with a corresponding slidable means;

an outer ring gear means in a phased relation to a driving gear means of the crankshaft, having a bore with a circular inner surface coaxial to and in rotatably slideable contact with the load-bearing periphery of said hub member, and having second cavity means therein;

said slideable means include at least one member with a phasing surface, slideably disposed within said first cavity means of said hub member, and said phasing surface slideably engaging a corresponding trailing surface in the second cavity means of said outer ring gear member, wherein a sliding action of the slideable means is translated into angular displacement between said hub and said outer ring gear.

2. The device as claimed in claim 1 wherein the hub member having: the load-bearing circular periphery coaxial to the longitudinal axis thereof, a first planar side substantially perpendicular to the longitudinal axis thereof, a second planar side substantially parallel thereto, at least one radial cavity leading inward from said periphery and open to said second planar side, said first cavity means including a plurality of cavities spaced equally on said periphery and each having its longitudinal axis extending non-convergingly inward, a first flat bottom bore leading inward from said first side coaxial to the longitudinal axis to receive the camshaft, a plurality of radially elongated holes therethrough spaced equally at equal radius from the center and along a circular center line thereof for removably interfacing the camshaft therethrough;

the outer ring gear member, having a circular toothed periphery of which the pitch diameter is concentric to the longitudinal axis and being circumferentially interfaced in a phased relation with the driving gear means of the crankshaft, a first planar side substantially perpendicular to the longitudinal axis and complementary with the planar surface of the first side of said hub member, a second planar side substantially parallel to said first side, said second cavity means including a plurality of cavities each having the trailing surface leading outward and each being equally spaced in the periphery of said bore and in phased communication with a corresponding cavity of said first cavity means;

the slideable means including a plurality of at least two centrifugal phasing weights having sides substantially perpendicular to each other, each having the bottom side angularly corresponding to the bottom of the receiving cavity of said hum member, each of said weights having the phasing surface at the top at an angle to the longitudinal axis thereof which slideably engages the trailing surface of the corresponding cavity of said ring gear means;

a first side cover, having a circular periphery fixedly interfacing a corresponding inner rim of said ring gear means, an inner bore concentric to said periphery forming an inwardly leading angle to the longitudinal axis thereof, and an inside planar surface which slideably interfaces a corresponding side of said hub member;

a second side cover having a circular periphery at an angle less than ninety degrees with respect to the inside planar surface thereof fixedly interfacing with said ring gear means, having a plurality of bleed-off holes therethrough equally spaced on a circular center line that is coaxial to said periphery, also having at least one slot on a circular center line coaxial to said periphery whose longitudinal side opening is larger within the inside planar surface thereof;

at least one spring means, longitudinally interfacing with the ends of the radial cavity of said hub member and of said corresponding slot within said second side cover forcing said hub member in a neutral position with respect to said ring gear means.

3. The device as claimed in claim 2 wherein the sides of said hub member, said gear member and each of said covers are coplanar and said side covers define the axial position of said hub member within said gear member.

4. The device as claimed in claim 2 wherein the plurality of cavities in said gear member being equally spaced and leading radially outward having two conjuncting sides thereof in a relative angle to each other which substantially corresponds to the angle of the phasing profile with respect to a leading side thereof.

5. The device as claimed in claim 2 wherein while in neutral position the centrifugal phasing weights are fully retracted and all in compression between the trailing surface of the cavity of said gear member and the bottom surface of the corresponding cavity of said hub member.

6. The device as claimed in claim 2 wherein the plurality of cavities through said hub member all longitudinally cut out therefrom and each substantially conforms to the configuration of the body of each said plurality of phasing weights which are being slideably disposed therein.

7. The device as claimed in claim 2 wherein the inwardly leading bore of said first side cover being angular thereto and thereby channels lubricating oil into each of said cavities of said hub and gear members.

8. The device as claimed in claim 2 wherein the plurality of bleed-off holes through said second side cover being aligned near an apex of each corresponding cavity of said gear member.

9. The device as claimed in claim 2 wherein the spring means being tensioned within the curved slot of said hub member and the corresponding slot of said second side cover, and workably retained therein by an inwardly expanding nest thereof within said second cover.

10. The device as claimed in claim 1 wherein:

the outer gear member having a shallow first bore concentric to the longitudinal axis and extending inward to a first planar surface, a second bore smaller than said first bore concentric thereto and extending inward to a second planar surface, a third bore smaller than said second bore being concentric thereto and extending through said gear member;

the hub member having a first shallow flat bottom bore extending inward from a first side and concentric to the longitudinal axis thereof to receive the camshaft, a smaller bore extending inward from said flat bottom concentrically to the longitudinal axis, a third bore extending from said flat bottom through the hub parallel to the longitudinal axis thereof, a second shallow flat bottom bore extending inward from a second planar side of said hub member and concentric to the longitudinal axis thereof.

11. The device as claimed in claim 10 wherein a first side cover is coplanar with the first planar surface of said ring gear member and also the first side of said hub member and being fusibly joined to said gear member and is in rotatable sliding contact with said hub member, defining the axial working limit of the hub within said gear member.

12. The device as claimed in claim 11 wherein the second side cover is being coplanar to the second side of said hub member and fixedly joined thereto.

13. The device as claimed in claim 1 wherein: the gear member having a first planar side adjacent to the camshaft supporting means, and a second planar side substantially parallel to said first side, a first bore extending from the second planar side inward to a bottom planar surface thereof and concentric to the longitudinal axis, a second bore through the gear member smaller in diameter than said first bore and concentric thereto, an inside groove circumferentially placed substantially near the top of said first bore, a second cavity means including a plurality of longitudinal cavities equally spaced on the periphery of said first bore each having an apex leading radially outward therefrom;

the hub member having a first side substantially perpendicular to the longitudinal axis, the load-bearing circular periphery concentric to the longitudinal axis in rotateable sliding contact with the periphery of the first bore of said gear member and with an axial length substantially equal to the depth of said first bore between the circumferential inside-groove and a bottom planar surface thereof, a planar second side parallel to the first side, a planar third side parallel to the first side and perpendicular to the longitudinal axis, a first bore concentric to the longitudinal axis leading inward from said first side to the inner planar surface thereof, a second bore from said inner planar surface through the hub member and concentric to said first bore to receive the camshaft, a first inside groove circumferentially placed within said first bore and concentric thereto, a second inside groove larger than the first groove circumferentially placed between said first groove and inner planar surface of said bore, a keyway within said second bore longitudinally placed therethrough for phasingly interfacing the hub member to the camshaft, said first cavity means includes a plurality of at least two cylindrical bores equally spaced in the load-bearing circular periphery each leading inward and having the periphery tangentially intersecting the second inside groove within said first bore;

the slideable means including a plurality of cylindrical phasing weights each having a phasing profile at the top end which is substantially perpendicular to the longitudinal axis of the bore, and there is a circumferential flatbottom groove placed substantially below the top within the periphery thereof;

a resilient dished retainer means being circumferentially compressed within the inside groove of said gear member exerting an inwardly directional force upon the planar second side of said hub member within said gear member; and a camshaft means having an outer-bearing journal, a first peripheral groove circumferentially placed near the inner end of said bearing journal, a second peripheral groove larger than said first groove circumferentially placed endward therefrom in communication with an oil-pressure supply thereto, a first reduced-diameter extending outward from said journal, a second reduced-diameter substantially shorter than said first reduced-diameter to interface a resilient "O" ring seal means thereon, a third reduced-diameter which extends to the end of the camshaft having a keyway cut longitudinally into the periphery thereof, a combination of interconnecting passage ways in communication with said oil-pressure supply and the second inside groove of said hub member, and a threaded bore extending from the end inward and in communication with said oil-pressure passage ways therein.

14. The device as claimed in claim 13 wherein each longitudinal cavity having a substantially straight leading-side which transists through an inside-radius into a curved trailing-side and through an outside-radius blends into the periphery of the first bore of said gear member.

15. The device as claimed in claim 13 wherein the dished retainer means having its inner periphery circumferentially in sliding contact with the second planar side of said hub member which is axially confined in a rotateably sliding contact with the bottom planar surface of the first bore of said gear member.

16. The device as claimed in claim 13 wherein each said plurality of phasing weights having a resilient "O" ring means in said flatbottom groove and sealably interacting in slideable contact with the wall of the cylindrical bore of said hub member.

17. The device as claimed in claim 13 wherein the resilient "O" ring seal means being disposed in crosssectional compression between the periphery of the first reduced diameter of the camshaft and the flat bottom of the first inside groove of the hub and in sealable contact with the two sides of said groove, and a second resilient "O" ring seal means smaller than said first "O" ring seal therein being in crosssectional compression between the two angularly conjuncting sides of the second reduced diameter of the camshaft and the two opposing angularly conjuncting sides of the first bore of the hub and the inner planar surface thereof, both said "O" ring seal means together with said components therein cooperatively define the path of the oil pressure supply therebetween.

18. The device as claimed in claim 13 wherein an annular locking thrustbearing means having a first side coplanar to a companion thrustbearing means being substantially perpendicular to the longitudinal axis, a longitudinal bore therethrough in slideable contact with the periphery of said journal, a bore larger than said first bore extending inward from the side opposite to said first side being concentric thereto and slideably interfacing a resilient locking ring means within a first peripheral groove of said journal.

19. The device as claimed in claim 18 wherein the periphery of the large bore slideably extends over the periphery of the resilient locking ring means which being removably disposed within the first peripheral groove of said journal and coaxially interfacing therewith, thereby provides a removable thrust bearing shoulder for said journal and together with other related components therein cooperatively defines the axial travel of the camshaft within the bearing means therefor.

20. A variable valve timing device of an internal combustion engine for adjusting relative angular position between a crankshaft and a camshaft having a central longitudinal axis wherein:

a pulley means having a circular periphery with teeth by which in a phased relation to a driving pulley of the crankshaft is being driven through a flat and toothed timing belt means, a first planar side being adjacent to a camshaft support means, a second side forward from said first side being substantially parallel thereto, a first bore extending longitudinally inward from said first side to a first planar bottom surface thereof, a second bore being concentric to said first bore and extending forward from the bottom surface thereof to a second planar surface that is perpendicular thereto, a third bore from said second planar surface extending through said pulley means and at least one inside helical groove cut into the periphery of said third bore throughout the length thereof, an inside groove circumferentially cut within said first bore being substantially near said first side;

a hub member having a first load-bearing circular periphery concentric to the longitudinal axis and a length substantially equal to the space between an inner edge of the inside groove and the first bottom surface in rotatably sliding contact with the periphery of said first bore of said pulley member, a first outer planar surface being perpendicular to the periphery and extending centerward therefrom, a second outer planar surface, a first inner planar surface extending centerward from said periphery and being perpendicular thereto, a shallow undercut extending longitudinally from the inner planar surface toward the first outer surface and having a flat bottom surface perpendicular to said periphery, a second concentric load-bearing periphery smaller in diameter than said first periphery extends from said undercut outward therefrom, a third concentric load-bearing periphery reduced in diameter extends to the outer end of the hub and having at least one outside helical groove cut thereon through the length of said periphery, a circumferential flat-bottom groove cut in said first periphery near the first outer planar surface, a first bore concentric to said periphery extending longitudinally inward from said first side and having a first inside flat-bottom groove concentric to the longitudinally axis in close proximity to an outer edge thereof, a second inside groove larger than said first groove therein, a third inside groove identical to the first inside groove being concentric to the longitudinal axis and in close proximity to an inner bottom surface of said first bore, a second inside bore concentric to the longitudinal axis through the hub member and having an inside keyway longitudinally cut therein, an angular end surface extends outward therefrom, at least one passageway angularly extending through the flat bottom of said under cut and intersects the second inside groove within said first bore;

an annular piston means comprising: a first load-bearing circular periphery concentric to the longitudinal axis and in rotatable sliding contact with the periphery of the second bore of said pulley member, a second circular load-bearing periphery concentric to the longitudinal axis being smaller in diameter than said first periphery and concavely conjoined thereto, a first load-bearing bore concentric to said first periphery and in rotatable sliding contact with the second load-bearing periphery of said hub member, a piston head being annular and extending centerward from said first periphery to said first bore, an outside flat-bottom groove circumferentially cut into said first periphery, an inside flat-bottom groove circumferentially cut into the periphery of said first bore, a second load-bearing bore extending forward from a bottom of said first bore and concentric thereto, at least one outside helical spline means extending forward from the end of said first periphery to an outer end of said piston means and convolutional with the inside helical groove within the third bore of said pulley member, at least one inside helical spline rising centerward from the load-bearing surface of said second bore and extending the full length thereof and convolutional with the outside helical groove within the third load-bearing periphery of said hub member;

the camshaft having an end journal extending beyond the bearing support therefor, a reduced diameter end portion extend outward from the end of said journal and coaxial thereto, a keyway longitudinally cut into the periphery of said reduced diameter end, a first hole concentric to the longitudinal axis leading inward from the outer end of said reduced diameter end and having a threaded portion therein, a blind hole coaxial to said first hole, a first passageway leading inward from the periphery of said journal and in communication with said blind hole and oil-pressure supply port within said bearing support means, a second passageway substantially near the reduced diameter end of said journal leading inward from the periphery and in communication with the first hole and the second inside groove within the first bore of said hub member, a key longitudinally interfaced within the keyways therefor in said hub and the reduced diameter portion of the camshaft, a circular end plate having a periphery substantially coangular with the end of said hub member and a cavity which interlockingly receives the overhanging end of said key thereinbetween.

21. The device as claimed in claim 20 wherein said pulley means having a plurality of resilient "O" ring seal means which are being sealably disposed within said grooves therefor and in cooperation with a resilient lock-ring means form an expandable pressure chamber.

22. The device as claimed in claim 21 wherein said pulley and said hub members conjointly form a pressure chamber in which said annular piston means is being sealably disposed and in which through said spline and groove means convolutingly causes angular displacement thereinbetween.

23. The device as claimed in claim 20 wherein said end-plate having the cavity extending from an inner planar surface towards an outer planar surface and at a radial distance from the center that is substantially equal to the radial distance of said key within said camshaft, said end-plate provides an end closure means for said key therein.

24. The device as claimed in claim 23 wherein said key removably interfaces said camshaft, said pulley means and said end-plate and cooperatively with a rotationally secured screw means removably secures said pulley means in a predetermined position on said camshaft.

25. The device as claimed in claim 20 wherein said annular piston means being axially confined between the flat bottom of said shallow under cut within said hub member and the second inner planar surface between the second and third bores of said pulley member thereby provides an internal limit for angular movement of said hub member with respect to said pulley member.

* * * * *